United States Patent [19]

Brundage

[11] Patent Number: 4,883,221

[45] Date of Patent: Nov. 28, 1989

[54] CARTON TRAY APPARATUS

[75] Inventor: David J. Brundage, Salinas, Calif.

[73] Assignee: Stone Container Corporation, Chicago, Ill.

[21] Appl. No.: 344,918

[22] Filed: Apr. 28, 1989

[51] Int. Cl.[4] ..... B65D 5/22

[52] U.S. Cl. ..... 229/143; 229/169; 229/174; 229/918

[58] Field of Search ..... 229/143, 147, 149, 169, 229/174, 918, DIG. 11, 164

[56] References Cited

U.S. PATENT DOCUMENTS

| | | | |
|---|---|---|---|
| 3,157,346 | 11/1964 | Hamilton | 229/143 |
| 3,871,570 | 3/1975 | Garmon | 229/143 |
| 4,197,980 | 4/1980 | Johnson | 229/174 |
| 4,349,147 | 9/1982 | Jensen | 229/143 |
| 4,385,721 | 5/1983 | Olsen et al. | 229/143 |
| 4,418,863 | 12/1983 | Kimbrell, Sr. | 229/143 |
| 4,537,344 | 8/1985 | Thomas | 229/143 |
| 4,546,913 | 10/1985 | Castillo | 229/164 |

FOREIGN PATENT DOCUMENTS

| | | | |
|---|---|---|---|
| 3439185 | 4/1986 | Fed. Rep. of Germany | 229/DIG. 11 |
| 2449618 | 9/1980 | France | 229/918 |
| 6908184 | 12/1969 | Netherlands | 229/169 |

OTHER PUBLICATIONS

Carton tray apparatus manufactured and sold by Georgia-Pacific Corporation (as shown in accompanying four photographs), date unknown.

*Primary Examiner*—Gary Elkins
*Attorney, Agent, or Firm*—Dick and Harris

[57] ABSTRACT

An articulable carton tray apparatus for containment and protection of articles, such as food produce articles, which apparatus may be assembled in a facilitated manner, with reduced amounts of paper materials, while being capable of resisting collapse during stacking and maintaining its assembled configuration under load and stress. The apparatus includes a bottom wall, and side, end and top walls. Flaps emanate from the side, end or top wall to align and lock to one another, remaining ones of the side, end or top walls—to maintain the apparatus in its articulated configuration, through locking means operably positioned within the flap. These locking means engage and co-operate with elements in the adjacent side, end or top wall. Support columns extend between the top walls and the bottom wall to further resist collapse of the apparatus during stacking.

16 Claims, 3 Drawing Sheets

CARTON TRAY APPARATUS

BACKGROUND OF THE INVENTION

The present invention relates in general to carton tray apparatuses, and in particular to an articulable tray apparatus for the containment and protection of articles such as food produce articles. The carton tray apparatus of the present invention resists collapse during stacking while maintaining its assembled configuration when full and under stress—while further being easy to assemble from a blank of minimum material.

A typical prior art carton tray apparatus comprises, in part, a single piece blank made from carton material, such as corrugated cardboard. The blank is divided into several regions, including a rectangular bottom wall, with two side walls and two end walls which extend contiguously from the opposed respective side and end edges of the bottom wall. Top walls extend from either or both the side walls and end walls. When the side and end walls are folded into an upright position, the side and end walls describe an article containment region. The top walls are then folded at right angles to either the side or bottom walls from which the top walls emanate, with the top walls configured to extend parallel to and in a spaced relationship with the bottom wall.

In such conventional apparatuses, some form of tab or flap is typically utilized to hold the side and end walls in their upright articulated position. A principal difficulty with most prior art designs is that the tabs or flaps, which are used to hold carton tray apparatuses in their articulated configurations, are typically configured along the outer periphery of the blanks from which the apparatuses are formed. Such flaps or tabs extend outwardly from the blank, and require that the original piece of carton material, from which the blank is cut and formed, must have a larger overall dimension than that actually necessary to form merely the side, end and top walls of the carton tray apparatus. If the amount of carton material which is used to form the blank can be reduced even by a small percentage, significant savings can be achieved in the production of such carton tray apparatuses, particularly when such carton tray apparatuses are produced in large quantities. Similarly, such an apparatus must be capable of being inexpensively and quickly articulated into its fully assembled configuration either by mechanical and/or manual means.

An additional consideration arises as a result of the stacking of such carton tray apparatuses. If each carton is heavily loaded, when they are stacked there will be a tendency for at least the top wall of each carton to be crushed by the corners of the bottom of the carton above it, since the top walls are not supported on all four sides. Accordingly, it is desirable to provide some form of support within the current tray apparatus to help resist the collapse and crushing of the top walls—while reinforcing the compressive strength of the side and end walls.

An example of a prior art carton tray apparatus is disclosed in U.S. Pat. No. 4,418,863, to Kimbrell. Kimbrell '863 discloses a carton tray apparatus generally as described which includes a reinforced corner construction. This reinforced corner construction takes the form of a flap which extends from the side wall and is then folded to form a support member which extends diagonally across a corner of the bottom wall and extends between the top and bottom wall. Once the side wall flap has been placed in its support position, it is held in place alternately by a slot and tab and friction configuration or by an obstructing flap which is pulled upwardly away from the bottom wall to block the side wall flap and preclude it from unfolding. The carton tray apparatus of Kimbrell '863 is held together in its articulated configuration by locking flaps which extend from the ends of the partial top wall. Each locking flap is then folded down across and alongside the ends of the side walls, and a holding tab which extends from an end of the locking flap is projected through a slot at the base and side wall and engages at the side wall. Examination of the unarticulated blank from which the Kimbrell '863 carton tray apparatus is formed reveals that the holding tabs, as is typical, extend from the peripheral portions of the locking flaps and extend outwardly from the main body of the blank, thus requiring an increase in the size of the original carton material from which the blank is cut, relative to the amount of carton material needed to form the bottom, side and end walls of the carton tray apparatus.

An additional example of a prior art carton tray apparatus is shown by a carton tray apparatus manufactured and sold by Georgia-Pacific Corporation, which, among others, is similar to the carton tray apparatus disclosed in formerly pending U.S. patent application Ser. No. 657,151, filed Oct. 3, 1984, now abandoned, which reveals a carton tray apparatus having reinforced corners. Both the Georgia-Pacific Corporation and the '151 carton tray apparatuses are assembled from blanks configured similarly to that of Kimbrell '863, and are held in their articulated configurations by locking flaps which extend from the ends of partial top walls which emanate from side and/or end walls. Locking tabs extend from the outer peripheral edges of the locking flaps and project through and engage locking apertures positioned at the base of the adjacent side or end walls, near where the respective side or end wall joins the bottom wall. Similarly to Kimbrell, these carton tray apparatuses require a larger sized orignal piece of carton material from which to form the blank.

It is thus an object of the present invention to provide a carton tray apparatus for the transportation and storage of articles such as food produce articles, which resists collapse during stacking. Accordingly, it is an object of the present invention to provide such a carton tray apparatus which includes a reinforced corner construction.

Another object of the present invention is to provide a carton tray apparatus which may be articulated from a single sheet of carton material, in a facilitated manner.

A further object of the present invention is to provide a carton tray apparatus, articulated from a single sheet of carton material, which is capable of maintaining its articulated configuration without the use of external binding means such as staples, glue, tape or other material.

Accordingly, another object of the present invention is to provide a carton tray apparatus articulated from a single sheet of carton material, which employs locking tabs to maintain its articulated configuration, which locking tabs emanate from interior portions of the sheet of carton material so as to reduce the amount of original carton material which must be employed to form the blank for the carton tray apparatus, while being capable of being easily deployed to its locked, fully articulated configuration.

These and other objects of the invention will become apparent in light of the present specification, drawings and claims.

SUMMARY OF THE INVENTION

The present invention comprises an articulable carton tray apparatus for containment and protection of articles, such as food produce articles. The apparatus resists collapse during stacking while maintaining its articulated configuration under stress—while capable of being assembled in a facilitated manner with a minimum of carton blank material and weight.

The apparatus comprises a bottom wall which has oppositely arranged first and second side edges and oppositely arranged first and second end edges. The bottom wall also has a plurality of corner regions. The first and second side edges extend substantially perpendicularly to the first and second end edges. First and second side walls extend along and emanate upwardly from the first and second side edges, respectively. First and second end walls extend along and emanate upwardly from the first and second end edges, respectively. First and second top walls extend along and emanate from the first and second end walls, respectively.

The bottom wall, the first and second side walls, and the first and second end walls, when articulated, describe an article containment region. Upon articulation, the first and second top walls extend substantially parallel to the bottom wall to at least partially cover the article containment region.

From at least one of either the first and second side walls, the first and second end walls, or the first and second top walls, emanate flap means. The flap means are to be operably aligned with an adjacent one of the first and second side walls, the first and second end walls, and the first and second top walls. The flap means include a peripheral portion and an internal portion.

To maintain the bottom wall, first and second side walls, first and second end walls, and first and second top walls in their articulated configuration, firt locking means are provided, which include at least one first locking member. The first locking member is positioned within and operably emanates from the internal portion of the flap means. The first locking member positively engages co-operating elements in an adjacent one of the first and second side walls, first and second end walls and first and second top walls.

Support column means are operably positioned in a support position between at least one of the first and second top walls, and the bottom wall, for resisting collapse of the carton apparatus during stacking.

The apparatus also comprises second locking means for maintaining the support column means in the support position. The first locking means and the second locking means, once the apparatus is in its articulated configuration, are substantially aligned relative to one another, so that they may be deployed simultaneously into their respective articulated locking positions. The second locking means comprises at least one second locking member which operably emanates from one of the first and second side walls, first and second end walls, and first and second top walls. The second locking member positively and lockingly engages the support column means to keep the support column means in its support position.

In a preferred embodiment of the invention, the support column means comprises at least one support column member which, upon articulation, is positioned in a support position between and substantially perpendicular to the bottom wall and at least one of the first and second top walls. In this embodiment, the support column member transversely spans at least a portion of one of the corner regions of the bottom wall.

In particular, the support column means includes at least one intermediate web member which emanates from the flap means, joined thereto along a common edge. The support column member emanates from the intermediate web member, and is joined thereto along a common edge. Fold lines extend along the common edges of the flap means, intermediate web member, and support column member.

In an alternative preferred embodiment of the invention, the intermediate web member emanates from at least one end edge of at least one of the first and second side walls, with the support column member emanating from the intermediate web member, and fold lines extending along the common edges thereof.

A preferred embodiment of the invention also includes stacking tab means for facilitating alignment of carton tray apparatuses relative to one another when they are stacked. The stacking tab means includes a plurality of stacking tab members which operably emanate in opposed pairs, from at least one pair of the first and second side wall means, the first and second end wall means, a pair of the flap means, and/or adjacent ones of the support column means to the pair of the flap means. In particular, the stacking tab means includes a plurality of primary stacking tab members which emanate upwardly in opposed pairs from the pairs of first and second side walls and first and second end walls. A plurality of secondary stacking tab members emanate upwardly in opposed pairs from one of the pairs of the flap means, and the pairs of support column means. The secondary stacking tab members are operably aligned with and cooperate with adjacent ones of the primary stacking tab members when the apparatus is assembled into its articulated configuration.

According to a preferred embodiment of the invention, the bottom wall, the first and second side walls, the first and second end walls, and the first and second top walls are formed from a single integrated piece of carton material such as corrugated cardboard which may additionally be treated to be moisture impervious. The first and second side walls are joined to the bottom wall along common edges at the first and second sides, respectively, so as to be articulable into a substantially perpendicular position relative to the bottom wall along fold lines extending along the common edges. Similarly, the first and second end walls are joined to the bottom wall at the first and second ends, respectively, and are articulable into a substantially perpendicular position relative to the bottom wall, along fold lines extending along the common edges. The first and second top walls are joined to the first and second end walls, respectively, along common edges extending parallel to the fold lines between the first and second end walls and the bottom wall. The first and second top walls are articulable into a plane substantially parallel to the bottom wall.

In the preferred embodiment of the invention, access holes are integrated into at least one pair of the first and second side walls and the first and second end walls. Aperture means may be additionally, preferably provided for facilitating ventilation of the article containment region to enable the facilitated transport of perishable produce food articles within the apparatus.

DETAILED DESCRIPTION OF THE DRAWINGS

Figure 1:
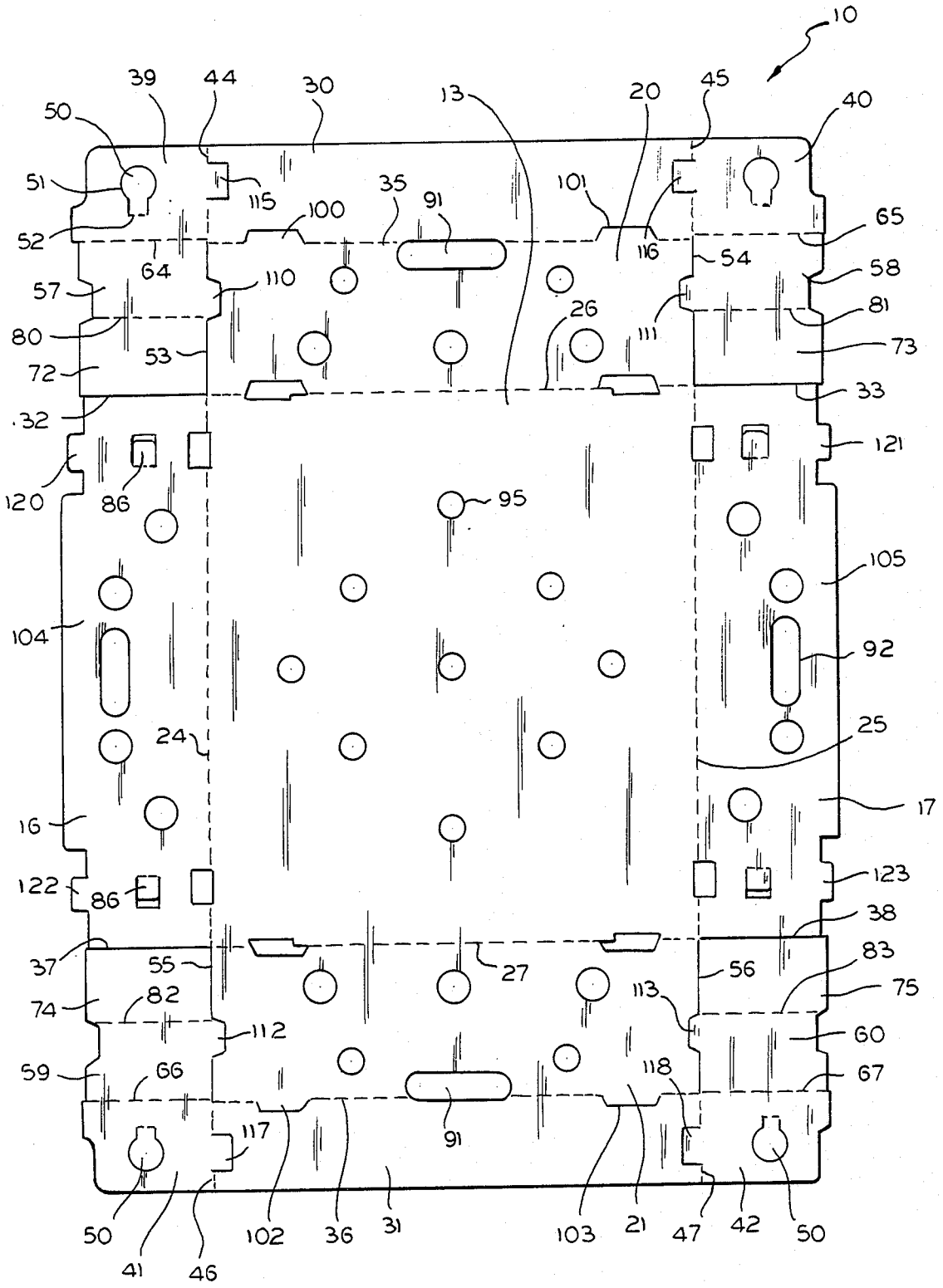
FIG. 1 is a top plan view of the carton tray apparatus as an unfolded, unarticulated blank.

While the present invention is susceptible of embodiment in many different forms, there is shown in the drawings and will be described herein in detail, a specific embodiment, with the understanding that the present disclosure is to be considered as an exemplification of the principles of the invention and is not intended to limit the invention to the embodiment illustrated.

Carton tray apparatus 10 is displayed in FIG. 1, in its unarticulated form, as a flat, substantially rectangular blank of carton material, such as corrugated cardboard, which may additionally be treated to be moisture impervious. The blank which forms carton tray apparatus 10 includes bottom wall 13, side walls 16 and 17, and end walls 20 and 21. Side walls 16 and 17 emanate contiguously from bottom wall 13. Fold lines 24 and 25, respectively, extend along the common edges of side walls 16 and 17, and bottom wall 13. Similarly, end walls 20 and 21 emanate contiguously from bottom wall 13, and fold lines 26 and 27, extend along the common edges of end walls 20 and 21, respectively, and bottom wall 13.

Top walls 30 and 31 emanate contiguously from end walls 20 and 21, respectively. Fold lines 35 and 36 extend along the common edges of top wall 30 and end wall 20, and top wall 31 and end wall 21, respectively.

In the preferred embodiment, flaps 39 and 40 project from the ends of top wall 30, along fold lines 44 and 45 respectively, and flaps 41 and 42 project from the ends of top wall 31, along fold lines 46 and 47 respectively. Within the internal portion of each of flaps 39–42 are located first locking tabs 50, which, in this preferred embodiment of the invention, are each die-cut into the blank along cuts 51, remaining attached to the blank at fold lines 52. Flaps 39–42 and first locking tabs 50, as described hereinbelow, maintain carton tray apparatus in its articulated configuration during use.

Intermediate webs 57–60 emanate, respectively, from flaps 39–42 along fold lines 64–67. Support columns 72–75, in turn, emanate, respectively from intermediate webs 57–60 along fold lines 80–83. As will be described herein, support columns 72–75, upon articulation of carton tray apparatus 10, assist in preventing collapse of carton tray apparatus 10, during stacking. Second locking tabs 86, embodying pivotable flaps, are used to retain the locked positions of support columns 72–75, once they have been deployed into their support positions. Intermediate web 57 and connected support column 72 are isolated from side wall 16 and end wall 20 by cut 32 and cut 53, while intermediate web 58 and connected support column 73 are isolated from side wall 17 and end wall 20 by cut 33 and cut 54. Similarly, intermediate web 59 and connected support column 74 are isolated from attachment to side wall 16 and end wall 21 by cut 37 and cut 55, while intermediate web 60 and connected support column 75 are isolated from side wall 17 and end wall 21 by cut 38 and cut 56.

Access openings 91 may be placed in end walls 20 and 21 to facilitate in the transport of loaded, articulated carton tray apparatuses 10. Access openings 92 may also be placed in side walls 16 and 17, in combination with, or in the alternative to access openings 91 to enable use of either set, as desired.

The blank from which carton tray apparatus 10 is formed also includes stacking tabs 100, 101, 102 and 103 or end walls 20 and 21, as well as stacking tabs 104 and 105 on side walls 16 and 17, respectively. In addition, tabs 110–113, which project from intermediate webs 57–60, respectively, upon articulation of apparatus 10, co-operate with stacking tabs 100–103 for reinforcement and locking therebetween. Additional stacking tabs 115–118 are formed as cut-out tabs in top walls 30 and 31 for cooperation, upon articulation, with tabs 120 through 123 respectively.

In order that food produce articles, which may be contained in carton tray apparatus 10, may be kept well ventilated, and if necessary, sprayed with cooling water to help keep them fresh, ventilation openings 95 may be located variously around the blank.

Since the structure and operation of carton tray apparatus 10 is substantially symmetrical relative to the two opposed end regions of the blank, the operation and articulation of carton tray apparatus 10 will be described in terms of one of the ends of blank 10, with the understanding that the description is equivalent for the other end of the blank.

Figure 2:
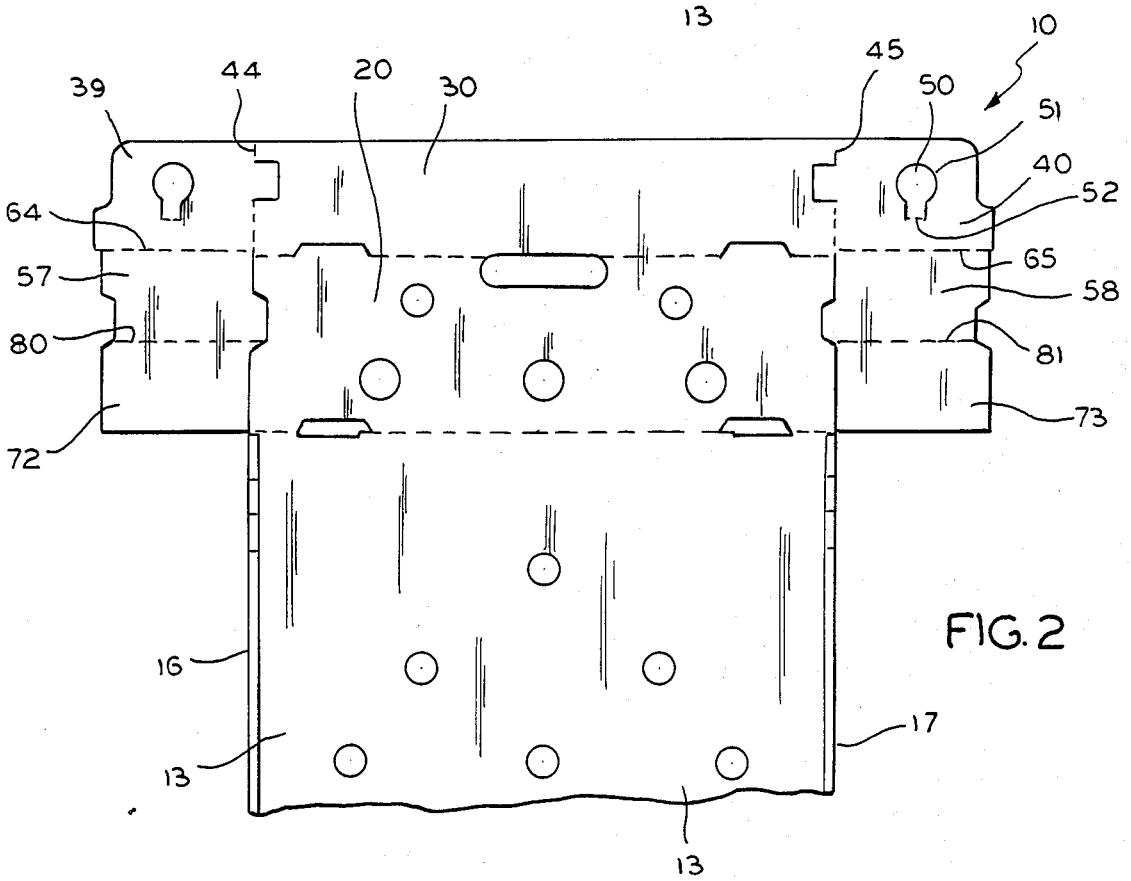
FIG. 2 is a top plan view of a portion of one end of the carton tray apparatus according to the present invention as it is articulated into its assembled configuration.

In FIG. 2, side walls 16 and 17 have been folded along fold lines 24 and 25 (not shown), toward the observer, as FIG. 2 is viewed. End wall 20 and connected top wall 30 remain in their unarticulated positions, as do flaps 39 and 40, with their associated intermediate webs 57 and 58 and support columns 72 and 73. Prior to articulation of end wall 20 into its operating position, support columns 72 and 73 are folded along fold lines 80 and 81 toward and substantially perpendicular to intermediate webs 57 and 58, respectively. Intermediate webs 57 and 58 are folded along fold lines 64 and 65 toward flaps 39 and 40, to bring intermediate webs 57 and 58 into substantially perpendicular relation to flaps 39 and 40. Flaps 39 and 40 are folded along fold lines 44 and 45 toward top wall 30, at which time top wall 30 may be folded along fold line 35 so as to be perpendicular relative to end wall 20. The proceeding articulations leave the end of carton tray apparatus 10 in the configuration shown in FIG. 3.

Figure 3:
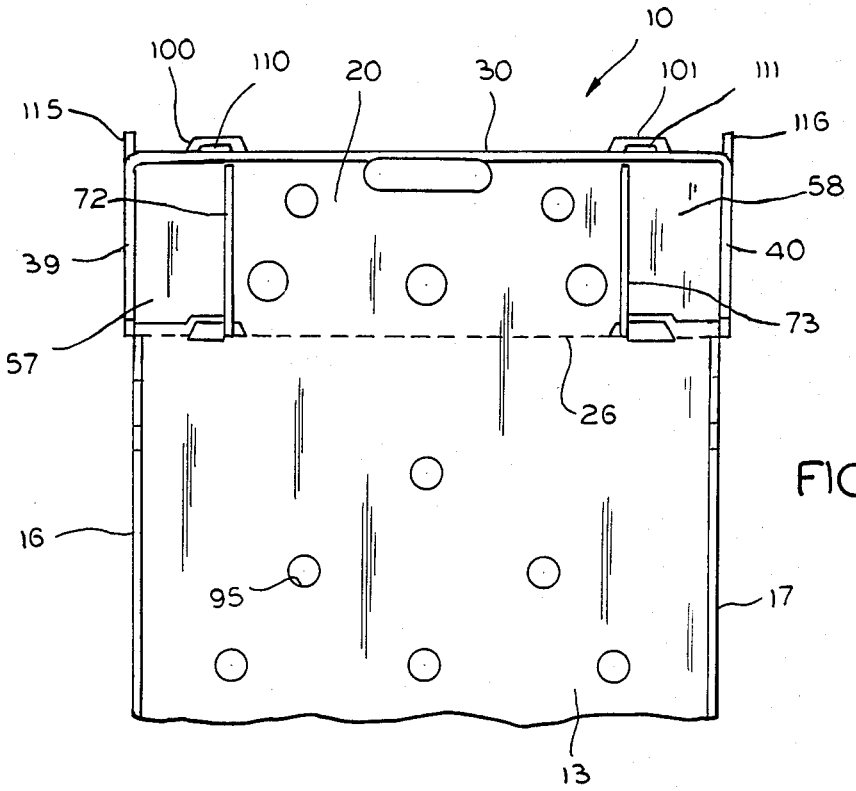
FIG. 3 is a top plan view of the carton tray apparatus, according to FIG. 2, showing the articulation of the top wall and flaps.

In the configuration of FIG. 3, flaps 39 and 40, support columns 72 and 73, and top wall 30 are now positioned at substantially right angles to bottom wall 13 and end wall 20. Stacking tabs 100 and 101 have become exposed, through the folding of top wall 30 relative to end wall 20, while stacking tabs 110 and 111, which extend from intermediate webs 57 and 58, respectively, have been inserted through the apertures produced through the exposure of end stacking tabs 100 and 101, so as to be positioned adjacent stacking tabs 100 and 101. Stacking tabs 115 and 116 are exposed as a result of the folding of flaps of 39 and 40. Once end wall 20 has been folded along fold line 26, apparatus 10 may assume the configuration shown in FIG. 4.

With end wall 20 folded along fold line 26 (shown in FIG. 3), top wall 30 takes a position substantially parallel to bottom wall 13. Tabs 120 and 121, which project from side walls 16 and 17, respectively, project through the apertures 130 and 131, which apertures result from the exposure of tabs 115 and 116, when flaps 39 and 40 are folded. Support columns 72 and 73 extend between bottom wall 13 and top wall 30, and project away from end wall 20 at substantially right angles.

Figure 4:
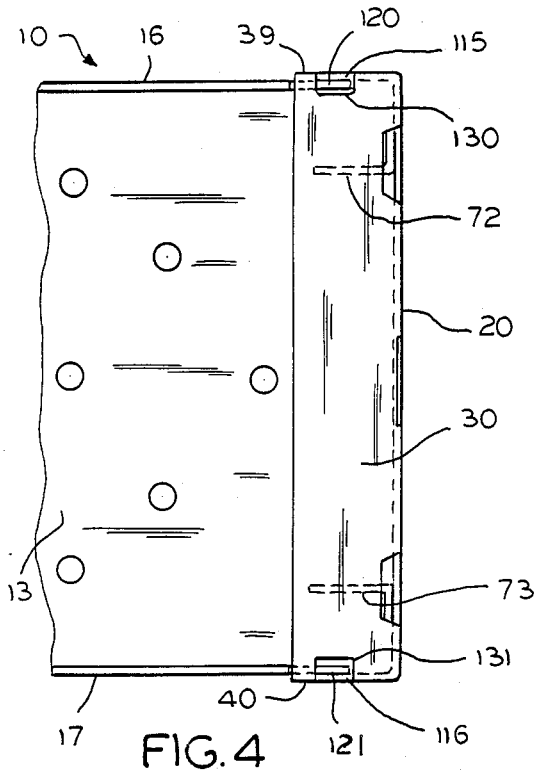
FIG. 4 is a top plan view of the carton tray apparatus, according to FIG. 2 showing the articulation of the end and top walls.
Figure 5:
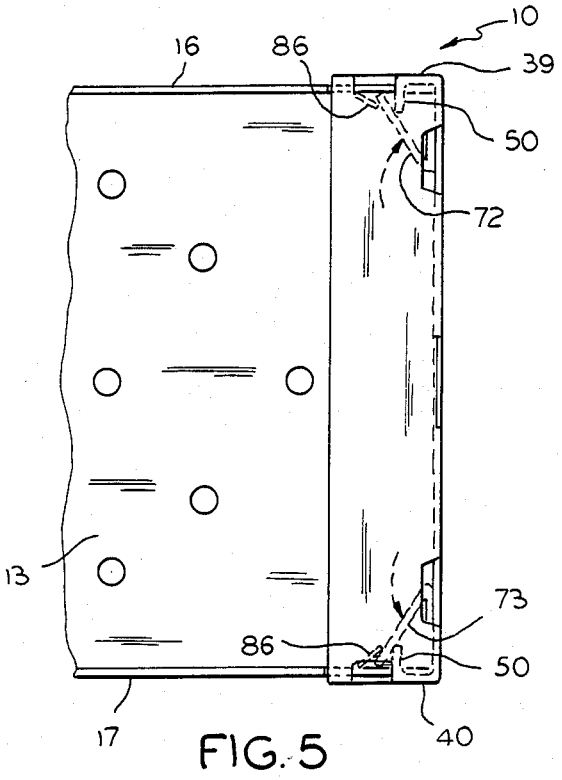
FIG. 5 is a top plan view of the carton tray apparatus; according to FIG. 4 showing the positioning and securing of the support columns upon further articulated assembly of the carton tray apparatus.
Figure 6:
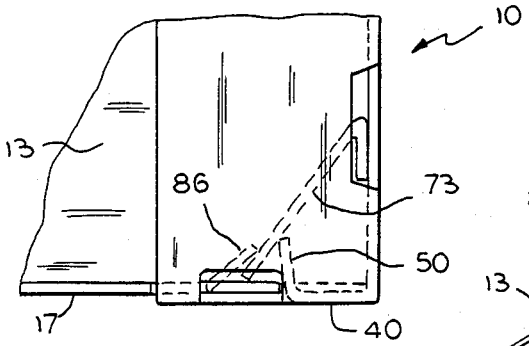
FIG. 6 is an enlarged view of a corner region of FIG. 5, showing in detail, the positive securement of the support column below the top wall.

With regard to FIGS. 4–6, it may be observed that intermediate webs 57 and 58 and their corresponding support columns 72 and 73 could also emanate from the ends of side walls 16 and 17, if reversed, as seen in FIG. 1, without departing from the spirit of the present invention. In particular, fold lines 64 and 65 would become cuts and cuts 32 and 33 would become fold lines.

The locking and securing of the end and top walls of apparatus 10, upon articulation, and the positioning of support columns 72 and 73 in their assembled support positions, is shown in FIGS. 5 and 6. Once apparatus 10 has been placed in the configuration shown in FIGS. 4, 5 and 6, first locking tabs 50 on flaps 39 and 40 are aligned with second locking tabs 86. In order to secure apparatus 10 in its articulated configuration and secure support columns 72 and 73 in their support positions, first locking tabs 50 and second locking tabs 86 are depressed inwardly so as to be reoriented away from their respective flaps 39 and 40 and side walls 16 and 17 as shown in FIGS. 5 and 6. Support columns 72 and 73 are then folded toward their respective side walls 16 and 17 and are prevented from unfolding through obstruction with second locking tabs 86. First locking tabs 50, which have been pushed through the apertures created by the deflection of second locking tabs 86, engagingly connect flaps 39 and 40, with respective side walls 16 and 17, and prevent the unfolding of top wall 30 and end wall 20 from their articulated positions as shown in FIGS. 4–6.

Figure 7:
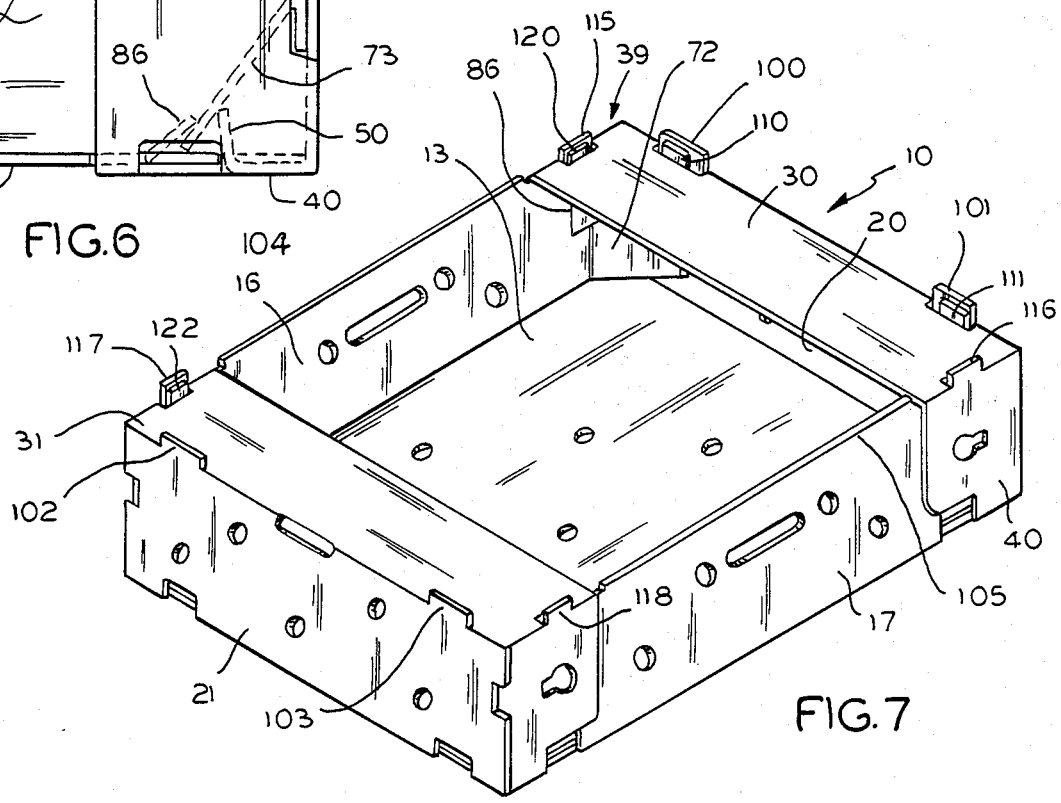
FIG. 7 is a top perspective view of a fully articulated carton tray apparatus, according to the present invention.

Carton tray apparatus 10 is shown in FIG. 7 in its fully articulated, assembled configuration. Support column 72 extends diagonally across a corner of bottom wall 13 and is prevented from migrating away from side wall 16 by second locking tab 86. Top walls 30 and 31 extend above and parallel to bottom wall 13 and partially cover the article containment region defined by side walls 16 and 17, end walls 20 and 21 and bottom wall 13. In addition to partially covering and enclosing the article containment region, top walls 30 and 31 assist in the stacking of one of apparatus 10 above another, as do the end stacking tabs 100–103 and side stacking tabs 104, 105, 115–118 as assisted by reinforcing tabs 110, 111, 112, 113 (co-operating 20 with tabs 100–103 respectively), and reinforcing tabs 120, 121, 122 and 123 (co-operating with tabs 115–118, respectively). While the dimensions of carton tray apparatus 10, as shown in the drawings, is shown with a longer dimension from end to end than from side to side, these proportions may be alternated without substantially altering the structure and operation of the invention.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An articulable carton tray apparatus for containment and protection of articles, such as food produce articles, which apparatus resists collapse during stacking while maintaining its assembled configuration under load, said carton tray apparatus comprising:

a bottom wall having oppositely arranged first and second side edges and oppositely arranged first and second end edges, said first and second side edges extending substantially perpendicular to said first and second end edges, said bottom wall further defining a plurality of corner regions;

first and second side walls extending along and emanating upwardly from said first second side edges respectively;

first and second end walls extending along and emanating upwardly from said first and second end edges, respectively;

first and second top walls extending along and emanating from said first and second end walls, respectively;

said bottom wall, said first and second side walls, and said first and second end walls, upon articulation of same, describing an article containment region;

said first and second top walls, extending, upon articulation, substantially parallel to said bottom wall to partially cover said article containment region;

flap means operably emanating from at least one of said first and second side walls, said first and second end walls, and said first and second top walls, for operable alignment with an adjacent respective one of said first and second side walls, said first and second end walls, and said first and second top walls, said flap means including a peripheral portion and an internal portion;

first locking means for maintaining said articulation of said bottom wall, said first and second side walls, said first and second end walls, and said first and second top walls, said first locking means including at least one first locking member positioned within and operably emanating from said internal portion of said flap means for operable positive engagement with said adjacent respective one of said first and second side walls, said first and second end walls, and said first and second top walls; and support column means, operably positioned, upon articulation, in a support position between at least one of said first and second top walls, and said bottom wall, for resisting collapse of said carton apparatus during stacking.

2. The articulable carton tray apparatus according to claim 1 wherein the invention further comprises:

second locking means for maintaining said support column means in said support position between said at least one of said first and second top walls, and said bottom wall.

3. The invention according to claim 2 wherein said first locking means and said second locking means, upon articulation of said bottom wall, said first and second side walls, said first and second end walls, and said first and second top walls, are substantially aligned relative to one another for simultaneous deployment of same into their respective articulated locking positions.

4. The invention according to claim 1 wherein said first locking means comprises:

means for releaseably retaining said first locking member, upon articulation, operably engaged with said adjacent respective one of said first and second side walls, said first and second end walls, and said first and second top walls.

5. The invention according to claim 2 wherein said second locking means comprises:

at least one second locking member operably emanating from one of said first and second side walls, said first and second end walls, and said first and second top walls, for positive locking engagement with said support column means for maintaining same in said support position.

6. The invention according to claim 5 wherein said support column means for resisting collapse of said carton apparatus during stacking further comprises:

at least one support column member operably positioned, upon articulation, in a support position between and substantially perpendicular to said bottom wall and said at least one of said first and second top walls, and transversely spanning at least a portion of at least one of said plurality of corner regions defined by said bottom wall.

7. The invention according to claim 6 wherein said support column means further comprises:

at least one intermediate web member operably emanating from said flap means, joined thereto along a common edge;

a fold line extending along said common edge between said flap means and said at least one intermediate web member;

said at least one support column member corresponding to and emanating from said at least one intermediate web member, joined thereto along a common edge; and a fold line extending along said common edge between said at least one support column member and said at least one intermediate web member.

8. The invention according to claim 6 wherein said support column means further comprises:

at least one intermediate web member operably emanating from at least one end edge of at least one of said first and second side walls, joined thereto along a common edge;

a folding line extending along said common edge between said at least one end edge and said at least one intermediate web member;

said at least one support column member corresponding to and emanating from said at least one intermediate web member, joined thereto along a common edge; and a fold line extending along said common edge between said at least one support column member and said at least one intermediate web member.

9. The invention according to claim 1 wherein said articulable carton tray apparatus further comprises:

stacking tab means for facilitating alignment of one of said carton tray apparatuses relative to another one of said carton tray apparatuses during the aligned stacking of same, said stacking tab means including a plurality of stacking tab members operably emanating upwardly in opposed pairs, from at least one pair of said first and second side wall means, a pair of said first and second end wall means, a pair of said flap means and adjacent ones of said support column means to said pair of said flap means.

10. The invention according to claim 9 wherein said stacking tab means further comprises:

a plurality of primary stacking tab members emanating upwardly in opposed pairs from said pairs of said first and second side walls and first and second end walls; and a plurality of secondary stacking tab members emanating upwardly in opposed pairs from one of said pairs of said flap means, and said pairs of said support column means, said secondary stacking tab members being operably aligned with and cooperating with adjacent ones of said primary stacking tab members upon said articulation of said bottom wall, said first and second side walls, said first and second end walls, said first and second top walls, and said flap means.

11. The invention according to claim 1 wherein said bottom wall, said first and second side walls, said first and second end walls, and first and second top walls are formed from a single integrated piece of carton material.

12. The invention according to claim 11 wherein said first and second side walls are joined to said bottom wall along common edges therebetween located at said first and second sides respectively and are articulable into substantially perpendicular relation to said bottom wall along fold lines operably located along said common edges between said first and second sides walls and said bottom wall.

13. The invention according to claim 11 wherein said first and second end walls are joined to said bottom wall along common edges therebetween located at said first and second ends, respectively, and are articulable into substantially perpendicular relation to said bottom wall along fold lines operably located along said common edges between said first and second end walls and said bottom wall.

14. The invention according to claim 13 wherein said first and second top walls are joined to said first and second end walls, respectively along common edges arranged parallel to said fold lines located between said first and second end walls, respectively, and said bottom wall;

said first and second top walls being articulable into a plane substantially parallel to said bottom wall along fold lines located at said common edges between said first and second top walls and said first and second end walls, repectively.

15. The invention according to claim 1 wherein said apparatus further comprises:

access means operably associated with at least one opposed pair of said first and second side walls and said first and second end walls.

16. The invention according to claim 1 wherein said apparatus further comprises:

aperture means for facilitating ventilation of said article containment region for enabling the facilitated transport and storage of perishable produce food articles therewithin said apparatus.

* * * * *

UNITED STATES PATENT AND TRADEMARK OFFICE

CERTIFICATE OF CORRECTION

PATENT NO. : 4,883,221

DATED : November 28, 1989

INVENTOR(S) : David Joe BRUNDAGE

It is certified that error appears in the above-identified patent and that said Letters Patent is hereby corrected as shown below:

| | |
|---|---|
| Col. 3, line 41 | "firt" should be instead -- first -- |
| Col. 7, line 61 | after "(co-operating" delete "20" |
| Col. 10, line 55 | "repectively" should be instead -- respectively -- |

Signed and Sealed this

First Day of December, 1992

*Attest:*

DOUGLAS B. COMER

*Attesting Officer*

*Acting Commissioner of Patents and Trademarks*